United States Patent [19]

Briner et al.

[11] Patent Number: 4,918,913

[45] Date of Patent: Apr. 24, 1990

[54] METHOD OF, AND DEVICE FOR, PERFORMING A START SPINNING OPERATION FOR SPINNING OF A YARN IN A FRICTION SPINNING APPARATUS

[75] Inventors: Emil Briner, Winterthur; Samuel Wehrli, Pfäffikon, both of Switzerland

[73] Assignee: Maschinenfabrik Rieter AG, Winterthur, Switzerland

[21] Appl. No.: 203,061

[22] Filed: Jun. 6, 1988

[30] Foreign Application Priority Data

Jun. 12, 1987 [CH] Switzerland ..... 02208/87

[51] Int. Cl.[5] ..... D01H 15/02

[52] U.S. Cl. ..... 57/263; 57/261; 57/401

[58] Field of Search ..... 57/261–263, 57/333, 350, 279, 280, 401

[56] References Cited

U.S. PATENT DOCUMENTS

| | | | |
|---|---|---|---|
| 3,685,267 | 8/1972 | Landwehrkamp et al. | 57/263 |
| 4,646,513 | 3/1987 | Briner et al. | 57/263 |
| 4,680,924 | 7/1987 | Briner et al. | 57/263 |

FOREIGN PATENT DOCUMENTS

| | | |
|---|---|---|
| 0175862 | 4/1986 | European Pat. Off. . |
| 0205962 | 12/1986 | European Pat. Off. . |
| 0222101 | 5/1987 | European Pat. Off. . |
| 3318687 | 11/1984 | Fed. Rep. of Germany . |
| 2480799 | 10/1981 | France . |
| 1231198 | 5/1971 | United Kingdom . |

*Primary Examiner*—John Petrakes

[57] ABSTRACT

For performing a start spinning operation in a friction spinning apparatus, upon starting or recommencing spinning of a yarn after yarn breakage, there are accomplished the following steps: fibers opened in a fiber sliver opening device are delivered by a fiber infeed duct to a rotating friction spinning drum and twisted into a twisted fiber structure or coil. When the coil has reached a substantially predeterminate diameter it is entrained by an air jet delivered by a blowing duct into a yarn entraining nozzle which deflects the coil and the yarn following the coil, before they reach the rotating yarn drawn-off rolls, axially of the yarn draw-off rolls, into a yarn guide duct. A suction device is located at the outlet of the yarn guide duct such that a negative pressure is produced therein for taking up the air from an injector part of the yarn entraining nozzle and the coil and the yarn following the coil and supplying such to the suction device. After the coil has passed by a non-continuous draw-off roll of the yarn draw-off rolls, the entraining air in the injector part and in the blowing duct is interrupted such that the yarn extracted by the suction nozzle is stretched and issues from the yarn guide duct through a slot therein and is guided between the yarn draw-off rolls. This yarn take-up by the yarn draw-off rolls accelerates the yarn to the operative yarn draw-off speed.

24 Claims, 12 Drawing Sheets

METHOD OF, AND DEVICE FOR, PERFORMING A START SPINNING OPERATION FOR SPINNING OF A YARN IN A FRICTION SPINNING APPARATUS

CROSS-REFERENCE TO RELATED PATENTS AND APPLICATION

This application is related to the commonly assigned, U.S. Pat. No. 4,646,513, granted Mar. 3, 1987, entitled "METHOD FOR PIECING A YARN IN A FRICTION SPINNING DEVICE", and the commonly assigned, U.S. Pat. No. 4,690,924, granted July 21, 1987, entitled "METHOD OF STARTING SPINNING OF A YARN IN A FRICTION SPINNING DEVICE". This application is also related to our commonly assigned, co-pending U.S. application Ser. No. 186,114, filed Apr. 25, 1988, and entitled "DEVICE FOR STARTING OR RECOMMENCING SPINNING OF A YARN IN A FRICTION SPINNING APPARATUS", to which reference may be readily had and the disclosure of which is incorporated herein by reference.

BACKGROUND OF THE INVENTION

The present invention relates to a new and improved method of, and device for, performing a start spinning operation entailing starting or recommencing spinning of a yarn or the like in a friction spinning apparatus.

Generally speaking, the method for performing a start spinning operation, meaning starting or recommencing spinning of a yarn or the like in a friction spinning apparatus, is of the type wherein free floating fibers are delivered in a fiber infeed or transport duct to a friction spinning surface of friction spinning means and conveyed on such friction spinning surface to a yarn formation position or location from which a yarn is withdrawn by yarn draw-off means, typically yarn draw-off rolls, during the yarn spinning operation.

The device for performing a start spinning operation is of the type which generally comprises a first friction spinning means having a friction spinning surface provided thereon to which there are delivered fibers. These fibers are formed into a twisted fiber structure or coil at a yarn formation position or location during performance of the yarn spinning operation. This twisted fiber structure or coil is withdrawn by a pair of yarn draw-off or withdrawal rolls, at least one roll of which is not continuous. In the context of this disclosure the term "non-continuous" or "not continuous" or equivalent expressions as applied to the one roll of the pair of yarn draw-off or withdrawal rolls, means that one such non-continuous roll is provided for each spinning apparatus or position. There is also provided a second friction spinning means which is arranged very near or in close proximity to the first friction spinning means but without touching the latter. Thus, there is formed a gap or nip of substantially constant but predeterminate width between the first and second friction spinning means.

The heretofore known devices for start spinning of a yarn employ a yarn end which is retracted from a bobbin and supplied, for performing the start spinning operation, to is started by infeeding fibers to the retracted yarn end at a reduced velocity of the friction spinning apparatus. It has also been proposed that prior to the start of spinning, in other words before the free floating fibers are fed to the inserted yarn end, the latter should be untwisted by movement of the friction spinning means in an opposite direction to enable better connection or interlacing of the delivered or infed fibers with the yarn end.

Such a device is known from the German Published Patent Application No. 3,318,687, in which a yarn end from a reverse rotated package is taken-up by a suction device and the yarn drawn-in by suction is retained by means of two lifting or reciprocating devices in the nip of two stationary friction spinning drums.

Before delivery of freely floating fibers to this yarn, the yarn is opened by reverse rotation of the friction spinning drums so that the fibers are in a substantially twist-free condition in the nip of the friction spinning drums. Thereafter, the friction spinning drums are placed into operation with reduced rotational speed in the normal direction or rotation and freely floating fibers are delivered to the opened yarn. The yarn which is thus produced, is withdrawn at a correspondingly reduced speed and delivered to a joining or connection means.

In order to take-up or handle the continuously delivered yarn during the time required for the joining or connection operation, the delivered yarn is received by a suction nozzle functioning as a yarn store or storage.

After completion of the joining or connection operation, the entire device is run-up or accelerated to the operating speed and thereafter is disconnected from the necessary auxiliary drive means and is driven by the normal drive means at the operating speed.

Certain of the disadvantages of a device of this type reside in the appreciable amount of auxiliary equipment needed for the start spinning operation. To overcome such drawbacks the herein named co-inventor, Emil Briner, devised along with a co-inventor Richard Hieronymi, a method for the start spinning of a yarn at a friction spinning device which could be accomplished in relatively uncomplicated fashion and through the use of relatively simple means.

The method according to such invention of Emil Briner and Richard Hieronymi has been disclosed in the aforementioned commonly assigned, U.S. Pat. No. 4,680,924, granted July 21, 1987, and in the cognate European Patent Application No. 86112564.9. As background, the invention of such U.S. Pat. No. 4,680,92, will be again disclosed herein with reference to FIGS. 1 to 7. When considering and describing FIGS. 1 to 7 of the instant disclosure, the same will be considered in an abbreviated form, in other words a description which does not include all of the reference characters appearing in the aforementioned U.S. Pat. No. 4,680,924, such being done merely to provide appropriate background information for understanding aspects and principles of the present development.

Even so, the method for performing a start spinning operation as described in the aforementioned U.S. Pat. No. 4,680,924, is afflicted with the shortcoming that there exists a certain unreliability in the engagement of the start of the yarn by the yarn draw-off or withdrawal means.

SUMMARY OF THE INVENTION

Therefore with the foregoing in mind it is a primary object of the present invention to provide a new and improved method of, and device for, performing a start spinning operation of a yarn or the like in a friction spinning apparatus, which does not suffer from the aforementioned drawbacks and shortcomings of prior art constructions.

Another and more specific object of the present invention is directed to a new and improved method of, and device for, performing a start spinning operation entailing starting or recommencing spinning of a yarn in a friction spinning apparatus, which affords reliable engagement of the yarn by the yarn draw-off or withdrawal means, typically yarn draw-off or withdrawal rolls, when performing the start spinning operation.

Yet a further important object of the present invention aims at the provision of a new and improved method of, and device for, performing a start spinning operation, entailing starting or recommencing spinning of a yarn in a friction spinning apparatus, which ensures that the yarn is only then engaged by the yarn draw-off or withdrawal means after such yarn possesses sufficient strength so that it will not tear or rupture when accelerated by the yarn draw-off or withdrawal means.

A still further significant object of the present invention is directed to the provision of a new and improved construction of a device for performing a start spinning operation and entailing starting or recommencing spinning of a yarn in a friction spinning apparatus, which start spinning device is relatively simple in construction and design, quite economical to manufacture, highly reliable in operation, not readily subject to breakdown or malfunction and requires a minimum of maintenance and servicing.

Now in order to implement these and still further objects of the invention, which will become more readily apparent as the description proceeds, the method for performing a start spinning operation entailing starting or recommencing spinning of a yarn in friction spinning apparatus is manifested, among other things, by the features that fibers are conveyed to the yarn formation location or position and twisted to form a twisted fiber structure or coil of substantially predeterminate size. The twisted fiber structure or coil and the yarn located subsequent thereto are conveyed by an air jet or a conveying airstream past the yarn draw-off or withdrawal means and engaged by yarn take-up means disposed after the yarn draw-off or withdrawal means considered in the direction of yarn movement. Thereafter, the air jet or conveying airstream is interrupted and the yarn is introduced into the yarn draw-off or withdrawal means.

As indicated previously, the invention is not only concerned with a start spinning method but also to a device for performing a start spinning operation entailing starting or recommencing spinning of a yarn in a friction spinning apparatus. The start spinning device of the present development is manifested, among other things, by the features that there is provided a blowing duct whose outlet is directed towards the yarn formation position or location and whose blowing direction is such that the dynamic pressure or thrust of the air jet is divided into two force components of different magnitudes, the larger one of such force components being effective in the yarn draw-off or withdrawal direction. A yarn guiding or guide element, such as a yarn guide duct, is provided between the friction spinning means and the yarn draw-off or withdrawal rolls and enables the twisted fiber structure or coil and part of the air jet in the blowing duct to pass by the non-continuous take-off roll of the yarn draw-off or withdrawal roll such that the twisted fiber structure or coil and the subsequent dispositioned yarn can be engaged by yarn take-up means, such as a suction device, disposed after the yarn draw-off or withdrawal rolls considered in the yarn take-off or withdrawal direction.

A notable advantage afforded by the present invention resides in the fact that the yarn draw-off or withdrawal means only then are required to take over or engage the yarn after the yarn has sufficient strength so that it will not tear or rupture when accelerated by such yarn draw-off or withdrawal means.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 15 schematically illustrates an eighth exemplary embodiment of start spinning device according to the present invention, constituting a modification of the arrangement of FIGS. 14 and 14*a.

DETAILED DESCRIPTION OF THE PREFERRED EMBODIMENTS

Figure 1:
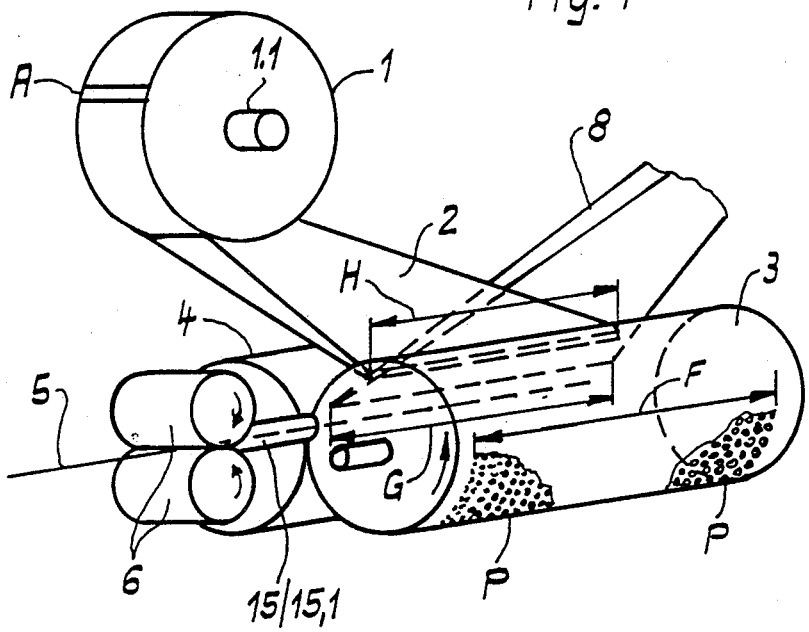
FIG. 1 is a partially schematic and perspective illustration of a friction spinning apparatus of the type disclosed in the aforementioned commonly assigned, U.S. Pat. No. 4,680,924, in order to provide certain background information to enhance comprehension of the present development.
Figure 2:
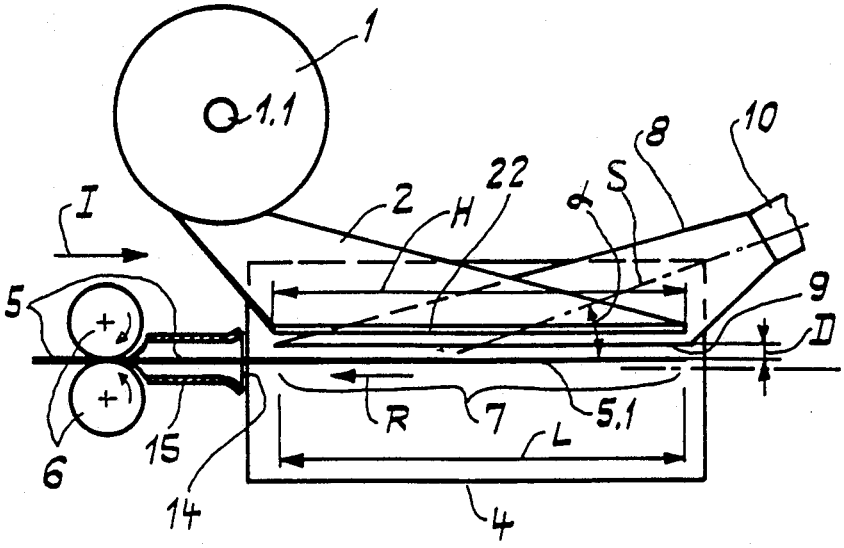
FIG. 2 illustrates part of the friction spinning apparatus depicted in FIG. 1 and illustrated in longitudinal direction and partially in section.

Describing now the drawings, it is to be understood that to simplify the showing thereof, only enough of the structure of the friction spinning apparatus and the related start spinning device has been illustrated therein as is needed to enable one skilled in the art to readily understand the underlying principles and concepts of this invention. Turning now specifically to FIG. 1 of the drawings, the friction spinning apparatus depicted therein will be seen to comprise, by way of example and not limitation, a fiber sliver opening device or fiber sliver opener 1 which is known from open-end spinning using a rotor. This fiber sliver opening device 1 comprises a suitable opening roll (not shown) and thus here generally indicated by its drive shaft 1.1 and an infeed or feed opening or aperture A through which there can be delivered and taken-up by the fiber sliver opening device 1 a sliver or fiber sliver or the like. By means of a fiber infeed or transport duct or passage 2 adjoining the fiber sliver opening device 1, freely floating fibers are delivered, by an air jet or airstream flowing through the fiber infeed or transport duct 2, to a friction spinning means, here shown as a rotatable and drivable perforated friction spinning drum or roll 3. As shown in FIG. 2, a yarn end 5.1 is formed at a yarn formation position or location 7 on the friction spinning drum or roll 3 and from which there is ultimately produced a yarn 5 or the like. The yarn end 5.1 is shown to possess a length L.

A further friction spinning means, here a counter roll or drum 4 which is also rotatable and drivable is arranged without contacting but in very close disposition with respect to the friction spinning drum or roll 3 and is disposed substantially parallel thereto, for instance at a spacing between 0.05 and 0.15 mm from the friction spinning drum or roll 3. This counter roll or drum 4 serves as an aid for twisting-in the fibers at the yarn formation position or location 7 and which are located in the convergence zone or nip of the two friction spinning drums or rolls 3 and 4. The finished or spun yarn 5 is drawn-off or withdrawn by yarn draw-off or withdrawal means, here shown in the form of a pair of yarn draw-off or withdrawal rolls 6. Such structure is known from earlier publications in this technology and constitutes state-of-the-art arrangements for friction spinning equipment, and thus, will not further be described herein. For example, the commonly assigned European Published Patent Application No. 0,175,862, published Apr. 2, 1986, shows a basically similar technique and thus reference may be readily had to such document, the disclosure of which is incorporated herein by reference.

Moreover, in addition to the fiber infeed or transport duct or passage 2 which opens at the yarn formation position or location 7, a blowing or pressure air infeed channel or duct 8 likewise opens over the yarn formation position or location 7 in the convergent region or nip of both of the friction spinning drums or rolls 3 and 4.

The blowing or pressure air infeed channel or duct 8 has a connection or connection stud 10 for connection thereof to a suitable and therefore not particularly illustrated compressed air network which contains all conventional elements necessary for controlling air pressure, air quantity and air flow.

As explained in the aforementioned U.S. Pat. No. 4,680,924, the length G of the exit opening 9 of the blowing or pressure air duct 8 corresponds at least to the length F (FIG. 1) of a perforated region of the perforated friction spinning drum 3, while the length H of the exit opening 22 of the fiber infeed or transport duct 2 corresponds at most to the length F of this perforated region. The perforated region is designated by reference character P in FIG. 1 and has only been conveniently partially illustrated.

Figure 3:
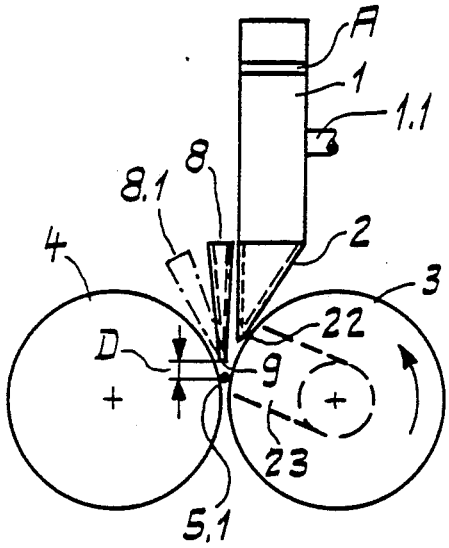
FIG. 3 shows part of the friction spinning apparatus of FIG. 1 in frontal view as seen in the direction of the arrow I of FIG. 2.
Figure 3A:
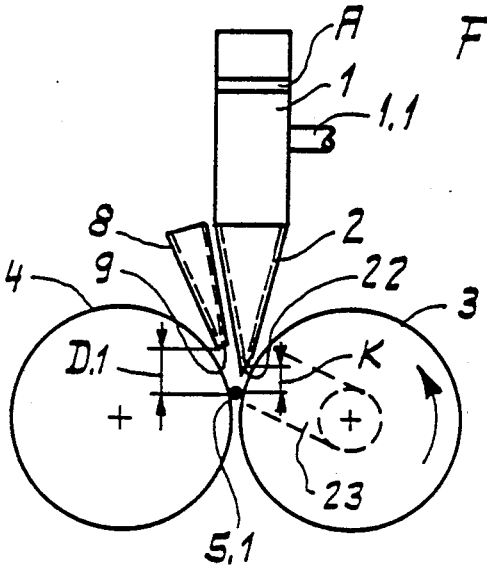
FIG. 3*a* shows a modification of the friction spinning apparatus of FIG. 3.

As also disclosed in the U.S. Pat. No. 4,680,924, the relation of the distance D (FIG. 3) or D.1 (FIG. 3*a*) between the exit opening 9 and the yarn end 5.1 located in the yarn formation position or location 7 to the intensity of air flow at this exit opening 9 of the blowing or pressure air duct 8 must be determined empirically. In FIG. 3*a* the distance D.1 is extended or enlarged to demonstrate that the exit opening or outlet 9 of the blowing or pressure air duct 8 can be further away from the yarn end 5.1 than the exit opening or outlet 22 of the fiber infeed or transport duct or passage 2. It will be seen that the exit opening or outlet 22 of the fiber infeed or transport duct or passage 2 is disposed at a distance K from the yarn end 5.1.

In the following description there will be considered the procedure for start spinning at the time of a fresh spinning operation, in other words, the start of the spinning operation, as well as also piecing-up after a yarn or thread break, in other words, upon recommencement or resumption of the spinning operation.

Figure 5:
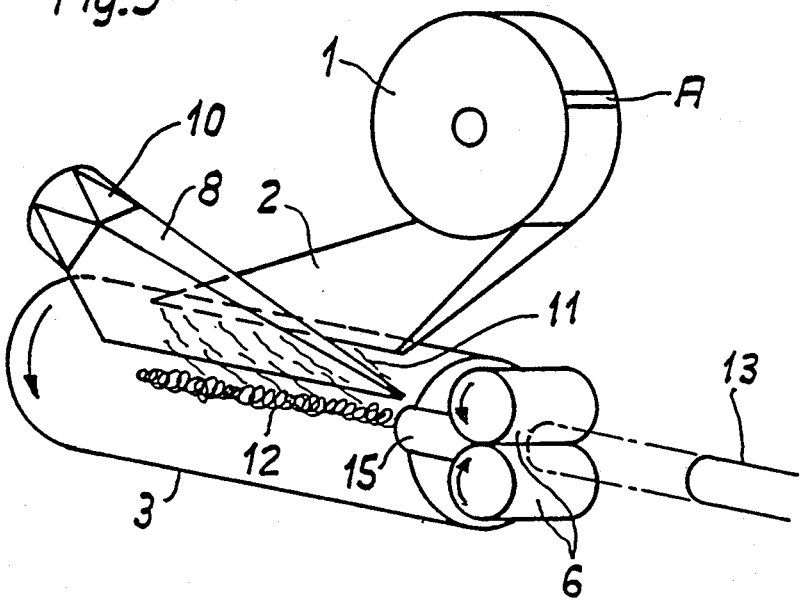
FIG. 5 partially shows the friction spinning apparatus of FIG. 1 from the opposite side, illustrated at one process stage of the start spinning operation.

As shown in FIG. 5, during the start spinning operation fibers 11 are initially supplied by the fiber infeed or transport duct 2 to the friction spinning drum or roll 3 without such fibers initially being withdrawn as yarn, so that there is formed an increasingly large rotating twisted fiber structure or coil 12.

In FIG. 5 the counter drum or roll 4 has not been shown in order to more clearly depict the twisted fiber structure or coil 12.

When the twisted fiber structure or coil 12 has reached a predeterminate size, then a suction device 13, for instance in the form of a suction nozzle and effective as a yarn take-up or receiving means, is moved to the diverging or output side of the yarn draw-off or withdrawal rolls 6, which rotate in the direction indicated by the arrows shown in FIG. 5, such as to be able to take-up the twisted fiber structure or coil 12 delivered by these yarn draw-off or withdrawal rolls 6.

Also, after the twisted fiber structure or coil 12 has reached the predeterminate size in the manner previously discussed, compressed or pressurized air is blown through the blowing or pressure air infeed duct or channel 8 so that the twisted fiber structure or coil 12 moves into inlet 14 of a guide tube 15 (see for instance FIG. 2) and through such guide tube 15 into the converging nip of the rotating pair of yarn draw-off or withdrawal rolls 6.

As FIG. 2 clearly shows, this guide tube 15 is disposed between the yarn draw-off or withdrawal rolls 6 and the end faces of the friction spinning drums or rolls 3 and 4 such that the axis of symmetry of the guide tube 15 lies substantially in an imaginary plane including the line of contact of the two yarn draw-off rolls 6 and that location on the friction spinning drum or roll 3 where the yarn 5 leaves such friction spinning drum or roll 3.

The inner diameter of the guide tube 15 is greater, for instance, twice as great as the outer diameter of the twisted fiber structure or coil 12.

As will be seen by further inspecting FIG. 2 the outlet or outlet side of the guide tube 15 can be formed with recesses so as to be adapted to the peripheral surface of the yarn draw-off or withdrawal rolls 6.

Figure 4:
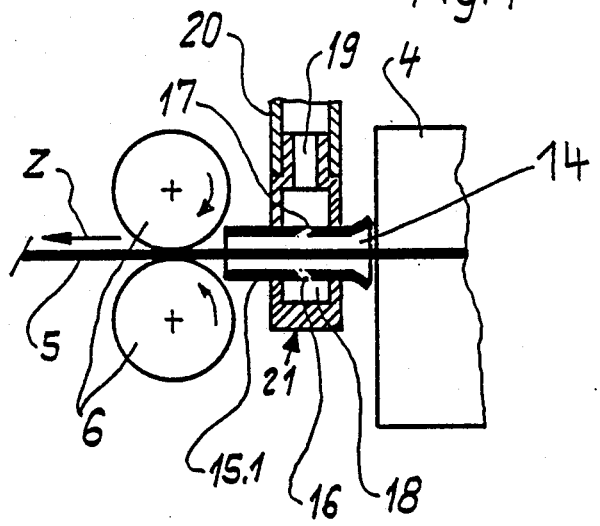
FIG. 4 shows, partly in sectional view, a modification of the friction spinning apparatus of FIG. 2.

Furthermore, and as shown in the arrangement of FIG. 4, the guide tube, there indicated by reference character 15.1, can possess the shape of an injector tube if air injection orifices or openings 16 and 17 are present and which impart to an air flow through such air injection orifices 16 and 17 a force component effective in the yarn draw-off or withdrawal direction Z. Such air flow is produced by an annular pressure chamber 18 which is at a positive pressure and which extends around the air injection orifices 16 and 17. The annular or ring-shaped pressure chamber 18 itself is supplied by means of a communicating bore 19 from a suitable compressed air system (not shown), having as its final element a connecting pipe or conduit 20. This connecting or connection pipe or conduit 20 is rigidly connected to a pressure casing or housing 21 receiving the annular pressure chamber 18 and communicating bore 19.

The pressure casing or housing 21 is operative to receive the guide or injector tube 15.1 rigidly or fixedly therein and seals the annular or ring-shaped pressure chamber 18 from atmosphere or the ambient surroundings.

The use of the injector tube or tube member 15.1 therefore has the advantage, in contrast to the guide tube 15, of being able to entrain the twisted fiber structure or coil 12 positively into the converging nip or gap of the yarn draw-off or withdrawal rolls 6 at the start of spinning.

Figure 6:
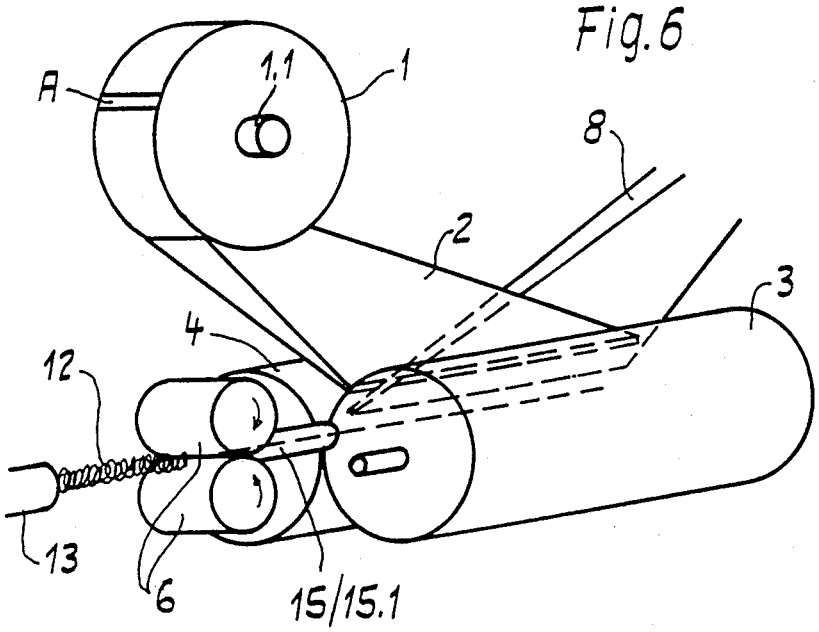
FIGS. 6 and 7 show the friction spinning apparatus of FIG. 1 for different process stages of the start spinning operation.
Figure 7:
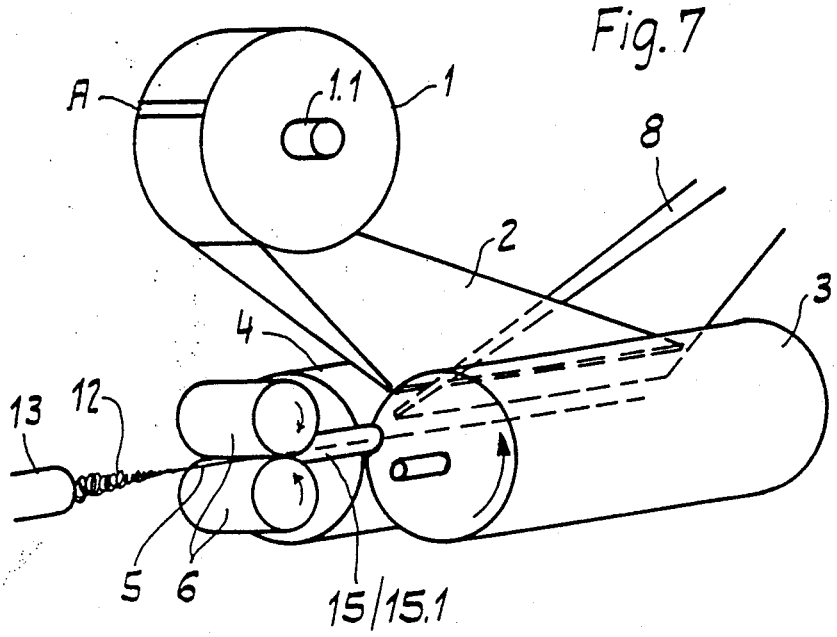

As indicated in FIGS. 6 and 7, upon leaving the yarn draw-off or withdrawal rolls 6, the twisted fiber structure or coil 12 is engaged by and sucked into the suction device 13 defining the yarn take-up or receiving means.

As shown specifically in FIG. 7, the trailing or subsequently positioned yarn 5, following the twisted fiber structure or coil 12, which is also subsequently sucked in, is guided by the suction device 13 to the other elements which are associated with the spinning frame (not shown) and need not here be further considered since the same do not constitute subject matter of the present invention.

Once the suction device 13 has engaged the twisted fiber structure or coil 12, then the airflow or airstream which passes through the blowing, or pressure air infeed duct or channel 8 and the airflow or airstream which flows through the guide or injector tube 15.1 are interrupted.

The heretofore described start spinning operation can be accomplished at full production speed so that the yarn delivered by the yarn draw-off or withdrawal rolls 6 corresponds to the yarn or thread or the like which is to be produced.

The described method can be, of course, also used with friction spinning devices employing, as opposed to friction spinning drums or rolls, a friction spinning disc to which the fibers are conveyed and from which the yarn is formed in a yarn formation position or location and drawn-off therefrom by yarn draw-off rolls. A friction spinning device of this type has been illustrated and described, for instance, in British Pat. No. 1,231,198, published May 12, 1971, to which reference may be had and the disclosure of which is incorporated herein by reference.

Instead of using a friction spinning roll or disc, there also can be used an appropriately perforated tape or band (not shown) and onto which the fibers are supplied in conjunction with a yarn formation position or location disposed perpendicular to the direction of movement of the perforated tape or band, in order to produce a yarn or the like. A friction spinning device of this type having such a tape or band is disclosed, for example, in the French Published Patent Application No. 2,480,799, published Oct. 23, 1981, to which reference may be readily had and the disclosure of which is incorporated herein by reference.

Moreover, instead of using the suction device 13 there also can be employed other suitable take-up means (not shown). All that is required is that the take-up means must be able to take up the twisted fiber structure or coil 12 and the yarn 5 which follows the same at production speed in the manner heretofore described.

It has also been found that an airstream of predeterminate intensity delivered by the blowing or pressure air infeed or duct or channel 8 and able to engage a twisted fiber structure or coil 12 of predeterminate size and to entrain such twisted fiber structure or coil towards the yarn draw-off or withdrawal rolls 6 becomes effective only when the twisted fiber structure or coil 12 has reached a correspondingly satisfactory size, which must be empirically determined.

Advantageously, the operational sequence is such that the fibers 11 are first supplied but the air flow starts only after a twisted fiber structure or coil 12 of the required or predeterminate size has evolved.

Moreover, the airflow can be started before the fibers 11 are supplied in order to clean the surface of the friction spinning drums or rolls 3 and 4, should that be required or desirable. This cleaning airflow can be, as described previously, optionally continued before the supply of the fibers 11 or can be interrupted before such fiber supply.

A chain-dotted line S in the showing of FIG. 2 denotes the central stream or airflow line of the airflow through the blowing or pressure air infeed duct or channel 8. The depicted angle $\alpha$ indicates that the flow line S is at such an inclination with respect to the yarn end 5.1 that the thrust or dynamic pressure produced by the airflow produces a force component R which is directed towards the yarn draw-off or withdrawal rolls 6 and which is effective on the twisted fiber structure or coil 12. Advantageously, this angle $\alpha$ is less than 45°.

At this juncture there will now be considered the various exemplary embodiments of start spinning devices depicted in FIGS. 8 to 15 and their mode of operation. Turning attention now specifically to FIG. 8, such is a plan view, looking in the direction indicated by arrow II in FIG. 8*a*, of the friction spinning drum or roll 3 together with the exit opening or outlet 22 of the fiber infeed or transport duct or passage 2. There is also depicted the counter drum or roll 4 which is disposed substantially parallel to the friction spinning drum or roll 3. Equally visible is the outlet or exit opening 9 of the blowing or pressure air infeed duct or channel 8 near the yarn formation position or location.

The pair of yarn draw-off or withdrawal rolls 6 comprise a continuous yarn draw-off or withdrawal roll 6*a*, here positioned as the lower roll of the pair, and a non-continuous yarn draw-off or withdrawal roll 6*b*, here thus the upper roll of such pair. The non-continuous yarn draw-off or withdrawal roll 6*b* has a drive shaft 24 at one end. That end of the non-continuous yarn draw-off or withdrawal roll 6*b* located remote from the drive shaft 24 is referred to hereinafter as the free shaft end 25. The yarn draw-off or withdrawal roll 6*b* is referred to as a non-continuous roll since it is only provided at the specific spinning station or position with which it is operatively associated and does not, in contrast to a continuous draw-off or withdrawal roll, such as the lower roll 6*a*, extend over numerous spinning stations or positions.

Continuing, it will be recognized that a yarn entraining or feed element or device, here a yarn entraining or feed nozzle 26 having an injector part or element 27 and merging into a tubular part or portion 28 is disposed between the pair of yarn draw-off or withdrawal rolls 6 and the end faces or surfaces 3*a* and 4*a* of the friction spinning drums or rolls 3 and 4, respectively. The injector part or element 27, defining an injector nozzle, is devised similar to the injector of the injector tube 15.1 shown and described with reference to FIG. 4.

The tubular part or portion 28 is provided at its outlet or outlet region 28*a* with a deflecting bend or curved portion 29 for deflecting the air flowing through the tubular part or portion 28 and the twisted fiber structure or coil 12 or yarn 5, as the case may be, entrained by such air or air flow in a direction substantially parallel to the rotational axes of the yarn draw-off or withdrawal rolls 6 towards the free end 25 of the non-continuous yarn draw-off or withdrawal roll 6*b*. This air deflection is augmented by the back-up or dynamic effect which prevails in the converging nip or gap between the yarn draw-off or withdrawal rolls 6. However, the deflecting bend 29 does not extend into the normal operative path or path of travel M of the yarn 5, such travel path M arising in operation when the yarn 5 is drawn-off regularly by the yarn draw-off or withdrawal rolls 6. The amount of curvature must be empirically determined.

A yarn guiding element, here shown in the form of a yarn guiding or guide duct 30 is provided to receive the deflected air and the twisted fiber structure or coil 12 or yarn 5, as the case may be, deflected by such air or airflow and to deflect the twisted fiber structure or coil 12 or yarn 5 around the free end 25 of the non-continuous yarn draw-off or withdrawal roll 6*b*. The yarn guiding or guide duct 30 has an inlet or inlet opening 31 which extends towards the tubular part or portion 28 such that inlet 31 of such yarn guiding or guide duct 30 can receive the air, the twisted fiber structure or coil 12 and the yarn 5, as the case may be, deflected by the deflecting or deflection bend 29.

Following the inlet 31 the aforedescribed yarn guiding or guide duct 30 has a bend or curved portion 32 which extends or curves around the free end 25 of the non-continuous yarn draw-off or withdrawal roll 6*b* and which is, in turn, followed by a bend or curved portion 33 which is curved or extends in the opposite direction.

Figure 8:
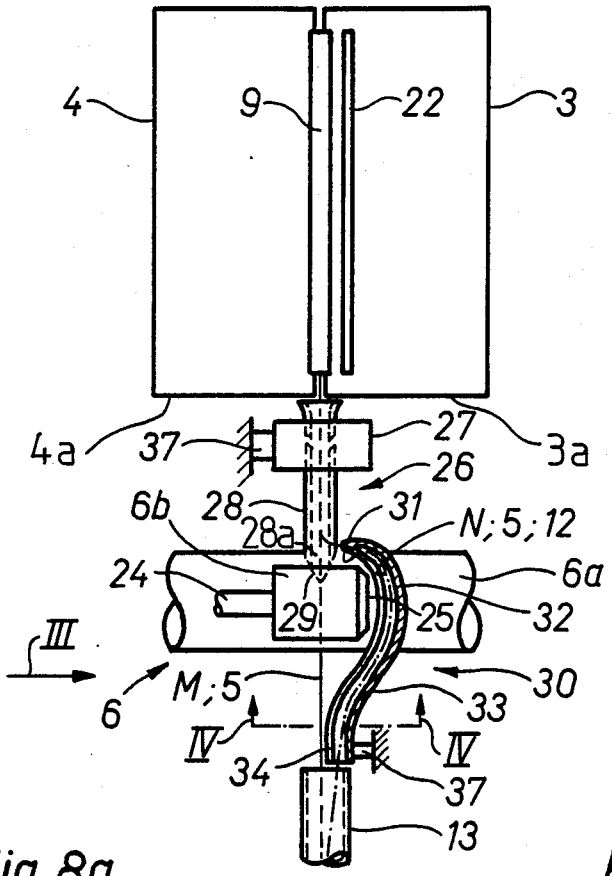
FIG. 8 schematically illustrates a first exemplary embodiment of start spinning device according to the present invention showing the yarn guiding or guide duct in section taken along line IVa—IVa in FIG. 8*b;*
Figure 8A:
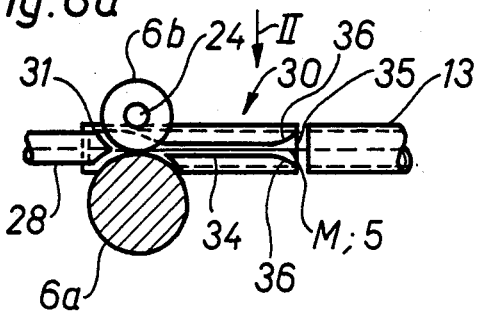
FIG. 8*a* illustrates part of the start spinning device of FIG. 8, looking in the direction of the arrow III thereof.
Figure 8B:
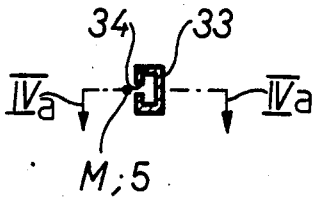
FIG. 8*b* is a sectional view of the start spinning device of FIG. 8, taken substantially along the section line IV—IV thereof.

As will be seen by referring to FIG. 8*a*, which shows the start spinning device of FIG. 1, partly in section looking in the direction of the arrow III of FIG. 8, and also be referring to FIG. 8*b* which is a section taken substantially along the line IV—IV of FIG. 8, the yarn guiding or guide duct 30 is formed over its entire length with a slot or opening 34 directed towards the non-continuous or yarn draw-off or withdrawal roll 6*b*. By means of this slot or opening 34 the yarn which is guided in the yarn guiding or guide duct 30 can, after the entraining air flowing in the blowing or pressure air infeed duct or channel 8 and the injector part or element 27 has been interrupted but the yarn 5 continues to be taken-up by the yarn take-up or receiving means, in other words the suction device 13, for instance a suction nozzle, issue from the yarn guiding or guide duct 30 through the slot or opening 34. This is so because of the pull or tension which is exerted by the suction device 13 upon the yarn 5, and thus the extracted yarn 5 can enter the nip or gap between the yarn draw-off or withdrawal rolls 6 and assume the operative path of travel or path M contemplated for the yarn 5. To facilitate this exit or threading-out of the yarn 5 from the slot or opening 34, the latter widens correspondingly towards the outlet 35 (FIG. 8*a*) of the yarn guiding or guide duct 30. Such slot widening or enlargement is represented in FIG. 8*a* by the rounded portions 36 forming slot enlargements.

The injector part or element 27 and the yarn guiding or guide duct 30 are each fixedly or rigidly arranged at a stationary casing or housing part 37 of the complete friction spinning apparatus while the tubular part or portion 28 is fixedly or rigidly connected to the injector part or element 27.

Yarn guidance during the start spinning operation or process is represented conveniently by chain-dotted lines in FIG. 8, to which there has been applied the reference character N and will hereinafter be referred to as start spinning yarn guidance or start-up spinning yarn guidance.

As will be apparent from the illustration of FIG. 8, the yarn 5 which is present either in the yarn path N at the start of spinning or in the yarn path M during normal operation, is extracted by the suction device or nozzle 13 heretofore described. Yarn speed during the start spinning operation, in other words during take-up by the suction device 13, may be less than the delivery speed of the yarn draw-off or withdrawal rolls 6. Consequently, when the yarn 5 issues from the path N into the clamping line or nip of the yarn draw-off or withdrawal rolls 6, in other words, into the operative path M, the yarn may experience a jerky acceleration which must not cause the yarn to tear or rupture.

The bypassing or shunting effect achieved, according to the invention, in terms of fiber material initially bypassing the non-continuous roll 6*b* provides the notable advantage that the relatively weak twisted fiber structure or coil 12 bypasses this non-continuous draw-off or withdrawal roll 6*b* in order to prevent the twisted fiber structure or coil 12 from becoming torn by the increase of speed previously discussed. This speed increase or acceleration, when start-up-spinning devices of the type as shown in FIG. 4 are used, may result in the subsequent part of the twisted fiber structure or coil 12 being deflected past the yarn draw-off or withdrawal rolls 6 axially thereof and therefore failing to be engaged thereby.

Figure 9:
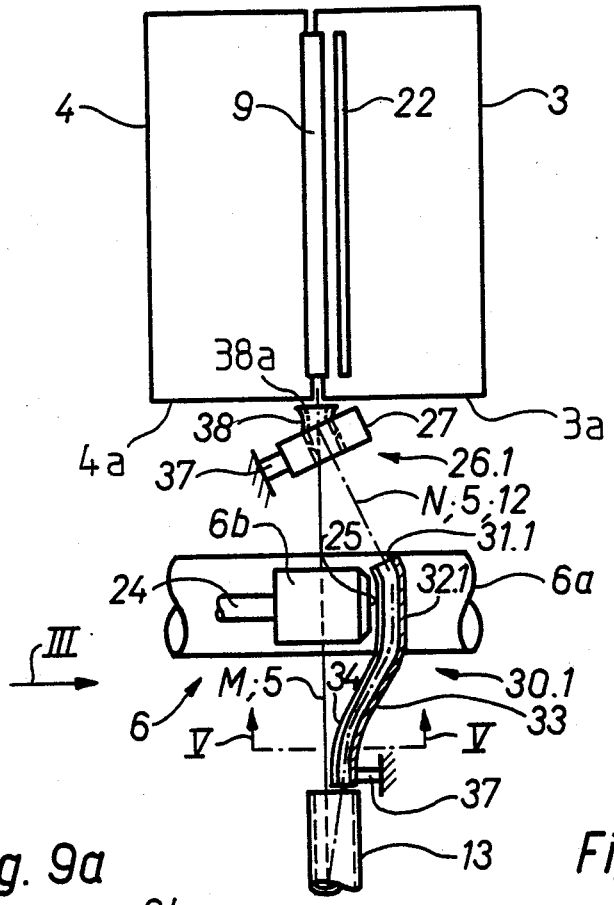
FIG. 9 is a schematic illustration of a second embodiment of start spinning device according to the present invention showing the yarn guiding or guide duct in section along line Va—Va of FIG. 9*b;*
Figure 9A:
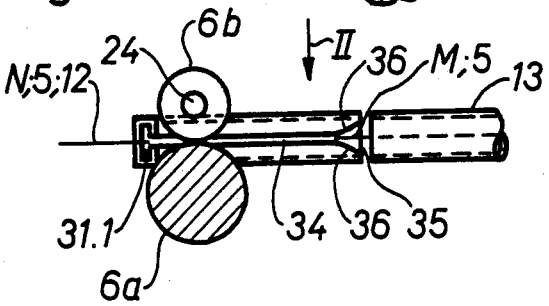
FIG. 9*a* is a fragmentary sectional view of the start spinning device of FIG. 9, looking substantially in the direction of the arrow III thereof.
Figure 9B:
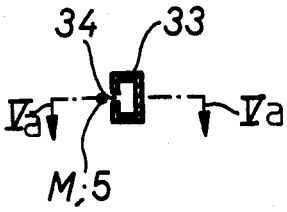
FIG. 9*b* is a sectional view of the start spinning device of FIG. 9, taken substantially along the section line V—V thereof.

FIGS. 9, 9*a* and 9*b* show a variant of the start spinning device used in conjunction with a friction spinning apparatus, from the construction of start spinning device and associated friction spinning apparatus depicted in FIG. 8, 8*a* and 8*b*. As a matter of convenience, elements or parts having the same function have been generally conveniently designated by the same reference characters. The embodiment of FIGS. 9, 9*a* and 9*b* differs from that previously described with reference to FIGS. 8*a*, 8*b* and 8*c*, in that at the start of spinning, the twisted fiber structure or coil 12 and the yarn 5 following the same are, after leaving the injector part or element 27, entrained in a free airstream produced by the injector part 27 along the start-up-spinning path N into inlet 31.1 of the bent or curved portion 32.1 of the yarn guiding or guide element or duct 30.1 and which extends around the free end 25 of the non-continuous yarn draw-off or withdrawal roll 6*b*.

Correspondingly, the inlet 31.1 of the bend 32.1 is open towards the start-up-spinning path N and the injector part or element 27 of the yarn entraining element or nozzle 26.1 of this variant embodiment is, as shown in FIG. 9, so aligned that the air jet or airflow strikes the inlet 31.1 of the bend 32.1. Also, the injector part or element 27 has, with advantage, an entry bend or curved portion 38 whose inlet 38*a* is directed towards the yarn formation position or location of the friction spinning drums or rolls 3 and 4.

The injector part or element 27 and the entry bend 38 are arranged such that the yarn 5 present in the operative yarn path M can pass without hindrance and freely through the injector part or element 27 and the entry bend 38, in other words, the operative yarn path M and the start-up-spinning path N extend through the entry bend 38 and the injector part or element 27.

Figure 10:
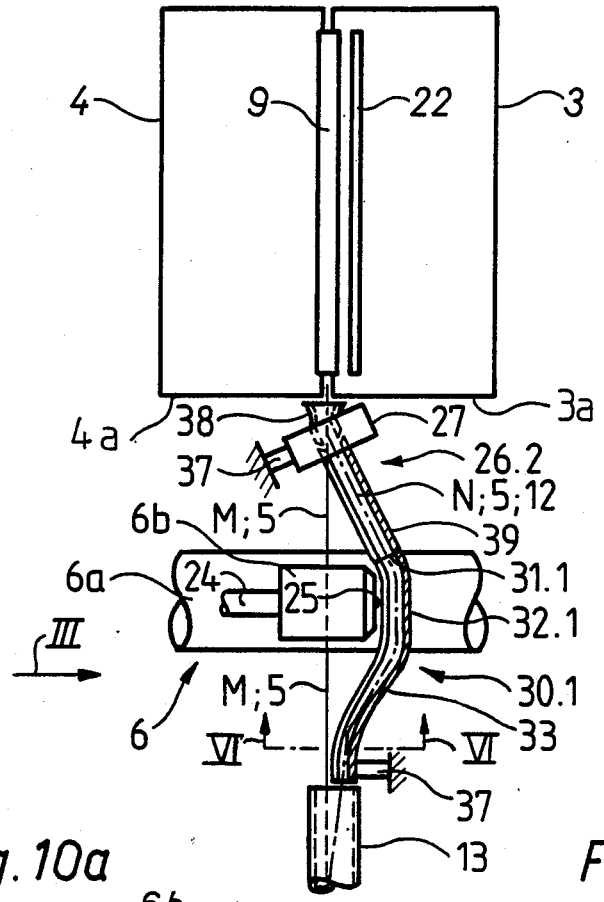
FIG. 10 is a schematic illustration of a third exemplary embodiment of start spinning device according to the present invention showing the yarn guiding or guide duct in section along line VIa—VIa of FIG. 10*b;*
Figure 10A:
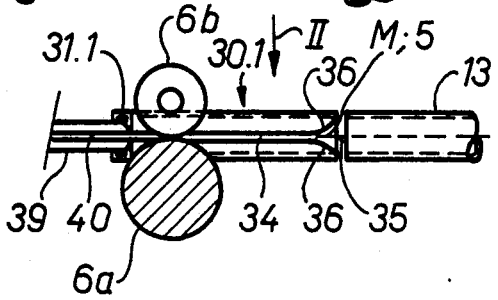
FIG. 10*a* is a fragmentary sectional view of the start spinning device of FIG. 10, looking substantially in the direction of the arrow III thereof.
Figure 10B:
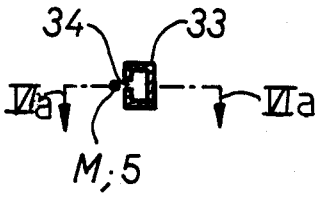
FIG. 10*b* is a sectional view of the start spinning device of FIG. 10, taken substantially along the section line VI—VI thereof.

FIGS. 10, 10*a* and 10*b* depict a further embodiment of the start spinning device and related friction spinning apparatus, in contrast to the embodiment depicted and described previously with reference to FIGS. 9, 9*a* and 9*b*. Here, a tubular part or portion 39, is provided between the injector part or element 27 of the yarn entraining nozzle 26.1 and the inlet 31.1 of the bend or curve portion 32.1. This part or portion 39 is rigidly secured to the injector part or element 27, and the outlet 39*a* of the tubular part or portion 39 is disposed substantially flush with the inlet 31.1 of the bend or curve portion 32.1 of the yarn guiding or guide element or device 30.1.

In order that the yarn 5 which is present in the start-up-spinning path N and which also extends through the tubular part or portion 38 may, for the required operation, enter the operative yarn path M, the tubular part or portion 39 is formed with a slot 40 (FIG, 10*a*) which is directed towards the yarn draw-off or withdrawal rolls 6 so that the yarn 5 can issue through this slot or opening 40 from the start-up-spinning path N into the operative path M.

In FIG. 10, the yarn guiding element or duct 30.1 and the tubular part or portion 39 are shown in section along the section line VIa—VIa of FIG. 10*b*, whereas FIG. 10*b* is a section taken along the section line VI—VI of FIG. 10.

Figure 11:
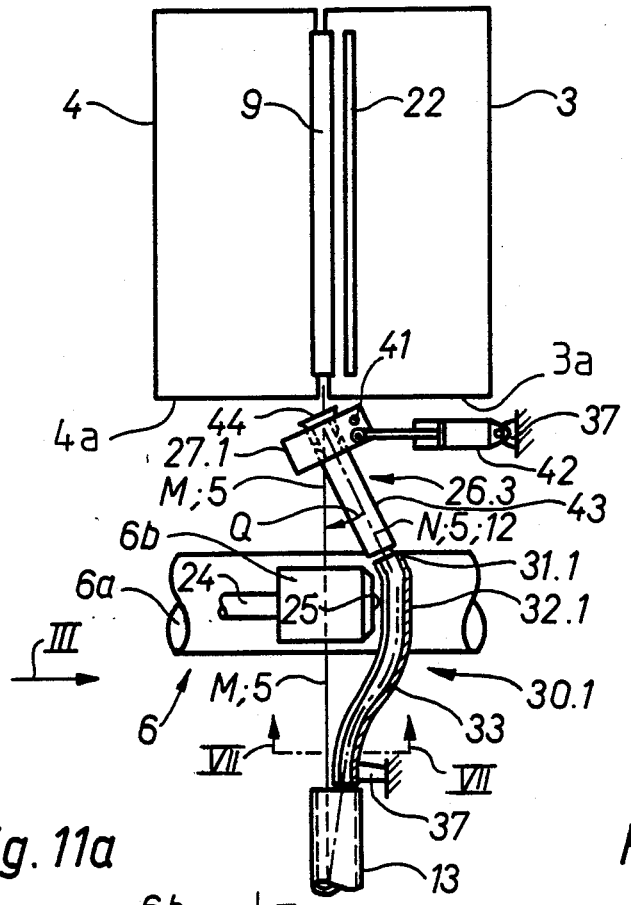
FIG. 11 schematically illustrates a fourth exemplary embodiment of start spinning device according to the present invention showing the yarn guiding or guide duct in section along line VIIa—VIIa of FIG. 11*b;*
Figure 11A:
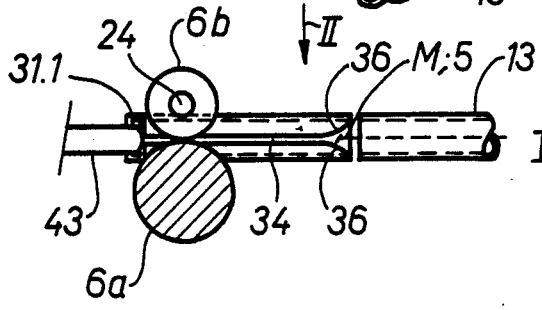
FIG. 11*a* is a fragmentary sectional view of the start spinning device of FIG. 11, looking substantially in the direction of the arrow III thereof.
Figure 11B:
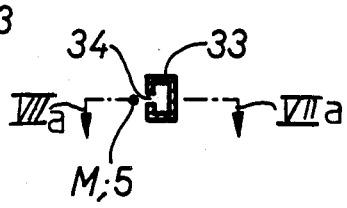
FIG. 11*b* is a sectional view of the start spinning device of FIG. 11, taken substantially along the line VII—VII thereof.

FIGS. 11, 11*a* and 11*b* depict a variant embodiment of start spinning device and related friction spinning apparatus from that shown in FIGS. 10, 10*a* and 10*b*, wherein, again as a matter of convenience, like elements or components have been generally conveniently designated by the same reference characters throughout.

The variant embodiment of FIGS. 11, 11*a* and 11*b* has a yarn entraining element or nozzle 26.3 and an injector part or element 27.1 which corresponds in function to the injector part or element 27 of the prior described embodiments of FIGS. 8, 8*a*, 8*b*, 9, 9*a*, 9*b* and 10, 10*a* and 10*b*, except that such yarn entraining nozzle 26.3 and injector part or element 27.1 are mounted for pivotal movement around a pivot pin or pivot means 41. This pivot pin 41 or equivalent structure is rigidly secured in a suitable casing or housing part which has not been particularly shown.

For pivoting, the injector part or portion 27.1 is pivotably connected to a suitable drive element or unit 42, shown in the form of a reciprocating actuator or piston-and-cylinder unit 42*a* in FIG. 11, which itself is appropriately pivotably connected to a stationary casing or housing part 37.

The yarn entraining element or nozzle 26.3 also has a tubular part or portion 43 which is rigidly connected to the injector part or element 27.1 and which extends away therefrom in the direction of yarn movement.

This injector part or element 27.1 has an inlet or inlet portion 44 on its side near the friction spinning drums or rolls 3 and 4.

With regard to the pivoting of the yarn entraining element or nozzle 26.3, the latter can be pivoted in a direction Q from a start-up-spinning position, which is shown in FIG. 11 and in which the twisted fiber structure or coil 12 and the yarn 5 are guided along the start-up-spinning path N, into an operative position in which the yarn 5 is guided in the operative path M. The pivoting of the injector part or element 27.1 can occur simultaneously with or immediately after the interruption of the hereinbefore referred to entraining air in the blowing or pressure air infeed duct or channel 8 and in the injector part or element 27.1, so that the yarn 5 can move from the start-up-spinning path N into the operative path M.

The control elements for the drive element or actuator 42 are not shown in any further detail and do not form part of this invention; also drive elements other than the actuator 42 shown in FIG. 11 can be used to produce the desired pivoting motion.

Figure 12:
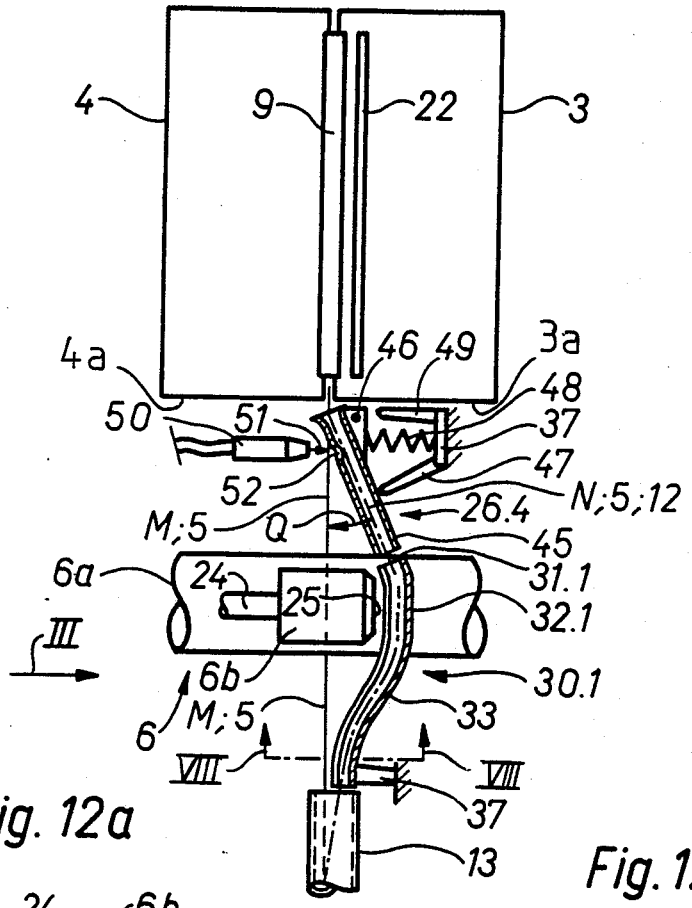
FIG. 12 schematically illustrates a fifth exemplary embodiment of start spinning device according to the present invention showing the yarn guiding or guide duct in section along line VIIIa—VIIIa of FIG. 12*b;*
Figure 12A:
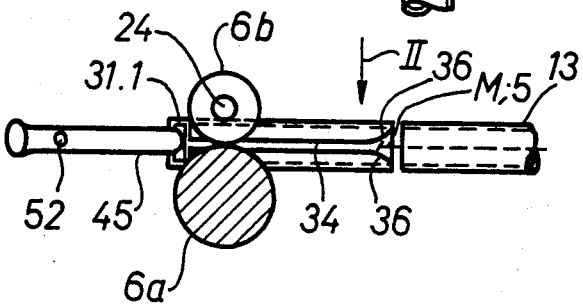
FIG. 12*a* is a fragmentary sectional view of the start spinning device depicted in FIG. 12, looking substantially in the direction arrow III thereof.
Figure 12B:
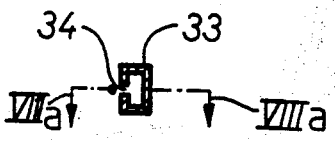
FIG. 12*b* is a sectional view of the start spinning device depicted in FIG. 12, taken substantially along the section line VIII—VIII thereof.

FIGS. 12, 12*a* and 12*b* show a further variant of the yarn entraining elements or nozzles, namely here the yarn entraining nozzle 26.4. The remaining elements correspond to those of the embodiment of FIGS. 11, 11*a* and 11*b*, so that again the same reference characters have been generally used for like elements.

The yarn entraining element or nozzle 26.4 comprises a straight tube or tube member 45 which is pivotably mounted on a pivot pin or pivot means 46. This pivot pin 46 or the like is rigidly disposed in a stationary casing part (not shown).

The substantially straight tube or tube member 45 is shown in FIG. 12 in longitudinal section and in the start-up-spinning position. In this position, the start-up-spinning path N extends through the substantially straight tube or tube member 45 and the latter abuts an abutment or stop member 47 secured to a stationary casing part 37.

The substantially straight tube or tube member 45 can be pivoted in the direction Q from the start-up-spinning position or path N into the operative position in which the operative yarn path M extends through the substantially straight tube or tube member 45.

Here, this pivoting movement is produced by means of a compression or pressure spring 48 which is effective between the straight tube or tube member 45 and the stationary casing part 37. When in the operative position, the straight tube 45 engages an abutment or stop member 49 also disposed rigidly on the stationary casing part 37.

To move the straight tube or tube member 45 from the operative position or path M into the start-up-spinning position or path N against the force of the compression spring 48, an air jet 51 issues from a blowing nozzle or nozzle member 50, then the issuing air jet 51 flows into an air inlet bore or opening 52 provided in the straight tube 45 and thus deflects this straight tube 45 into the start-up-spinning position. The air jet or airstream 51 is also used in the straight tube 45 as an entraining air jet or airflow for the twisted fiber structure or coil 12 or the yarn 5 following the same, as the case may be.

This air jet or airstream 51 is interrupted simultaneously as the entraining air from the blowing or pressure air infeed duct or channel 8 is interrupted so that the yarn 5 is moved into the operative path M by the pivoting movement in the direction Q.

Figure 13:
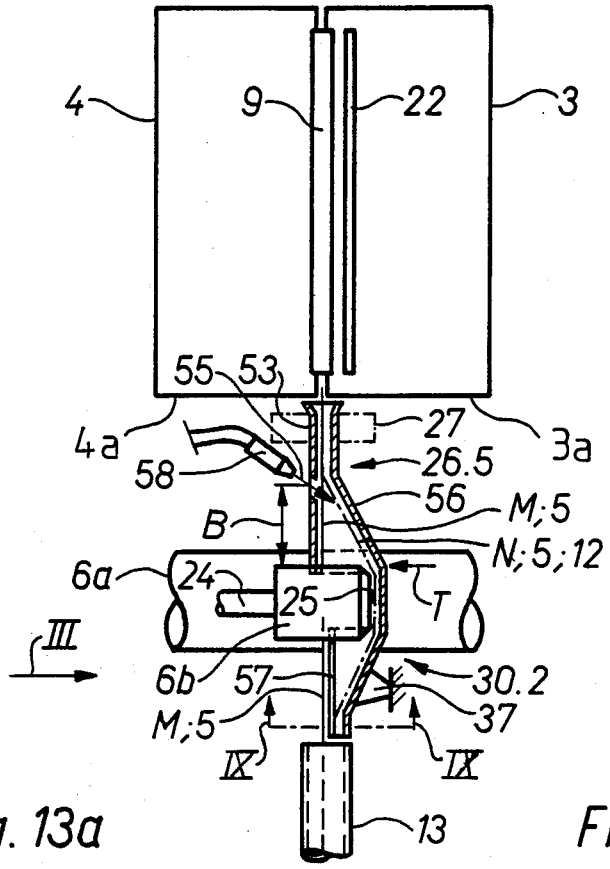
FIG. 13 schematically a sixth exemplary embodiment of start spinning device according to the present invention showing the yarn guiding or guide duct in section along line IXa—IXa of FIG. 13*b;*
Figure 13A:
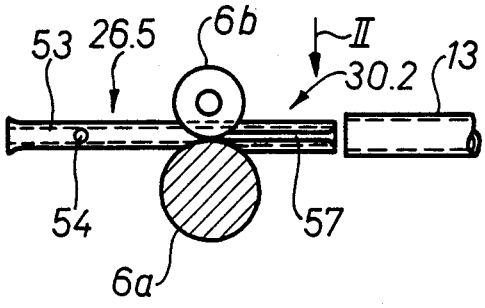
FIG. 13*a* is a fragmentary sectional view of the start spinning device depicted in FIG. 13, looking substantially in the direction of the arrow III thereof.
Figure 13B:
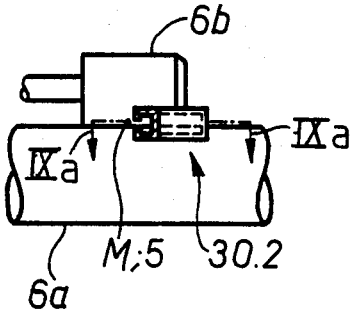
FIG. 13*b* is a sectional view of the start spinning device depicted in FIG. 13, taken substantially along the section line IX—IX thereof.

FIGS. 13, 13*a* and 13*b* again show a variant of the yarn guiding elements illustrated in FIGS. 8, 8*a*, 8*b*, 9, 9*a*, 9*b*, 10, 10*a*, 10*b*, 11, 11*a*, 11*b*, 12, 12*a* and 12*b*. It is to be understood that the term "yarn guiding elements" basically denotes the combination of a yarn entraining element or nozzle with a corresponding yarn guide element, here the yarn guiding or guide duct. In this embodiment the yarn entraining element or nozzle 26.5 and the yarn guiding element or duct 30.2 are rigidly interconnected to form a yarn guiding element. Correspondingly, the yarn entraining nozzle 26.5 and the yarn guiding duct 30.2 are separated at a location indicated by an arrow T (FIG. 13) only as regards their different functions.

FIG. 13 is a plan view looking in the direction of arrow II of FIG. 13*a* and also is a partial sectional view taken along the section line IXa—IXa of FIG. 13*b*. FIG. 13*a* is a side view looking in the direction indicated by the arrow III of FIG. 13 and FIG. 13*b* is a section on the line IX—IX of FIG. 13. As explained, the yarn guiding element as shown in section in FIG. 13 is a sectional illustration taken substantially along the section line of FIG. 13*b*.

As to the remaining elements or components, the elements discussed previously in relation to the prior explained embodiments here too have the same reference characters generally used in conjunction therewith as previously employed.

Continuing, it will be observed that the yarn entraining element or nozzle 26.5 has a first wall or wall member 53 which is substantially parallel to the yarn guidance direction or operative position or path M and which is formed at a predeterminate distance B from the non-continuous yarn draw-off or withdrawal roll 6*b* with an injection orifice or port 54 for an entraining air jet or airstream 55.

Also a second wall or wall member 56 is disposed opposite the first wall or wall member 53, extends substantially parallel thereto as far as the position located opposite the injection orifice or port 54, and is then bent away from the first wall or wall member 53 so as to merge at the functional interface T into the yarn guiding or guide duct 30.2 to form the bypass or shunt around the free end 25 of the non-continuous yarn draw-off or withdrawal roll 6*b*.

The yarn entraining element or nozzle 26.5 therefore receives both the operative yarn path M and the start-up-spinning yarn path N. Also, the yarn guiding or guide duct 30.2 is formed with a slot or opening 57 which is effective in the same way as the slot or opening 34 hereinbefore described, so that the yarn 5 engaged by the yarn draw-off rolls 6*a*, 6*b* can pass through the slot or opening 57 into the operative yarn path M.

The air jet or airstream 55 is produced by a blowing nozzle or nozzle member 58 which can either be stationary or freely mobile. In the latter case, it is advantageous to provide a suitable abutment or stop (not shown) so that this air jet 55 can be injected into the injection orifice or port 54 at a predeterminate angle, for instance, the angle shown in FIG. 13.

The yarn entraining element or nozzle 26.5 is rigidly disposed on the stationary casing or frame part 37 upon securing the yarn guiding or guide duct 30.2.

Also, and as indicated by chain-dotted lines, an injector part or element 27 can be provided near the air jet or airstream 55 in order to boost entrainment of the twisted fiber structure or coil 12 or yarn 5, as the case may be, as far as the deflection location embodied by the inclined wall 56 and the air jet 55.

The drawing-in of the yarn 5 or the like between the yarn draw-off or withdrawal rolls 6*a* and 6*b* is effected by interrupting the airstream from the blowing or pressure air infeed duct 8 and blowing nozzle 58, and, where applicable, that of the injector part or element 27 while the yarn 5 continues to be extracted by the suction device or nozzle 13 constituting the aforementioned yarn take-up or receiving means.

Figure 14:
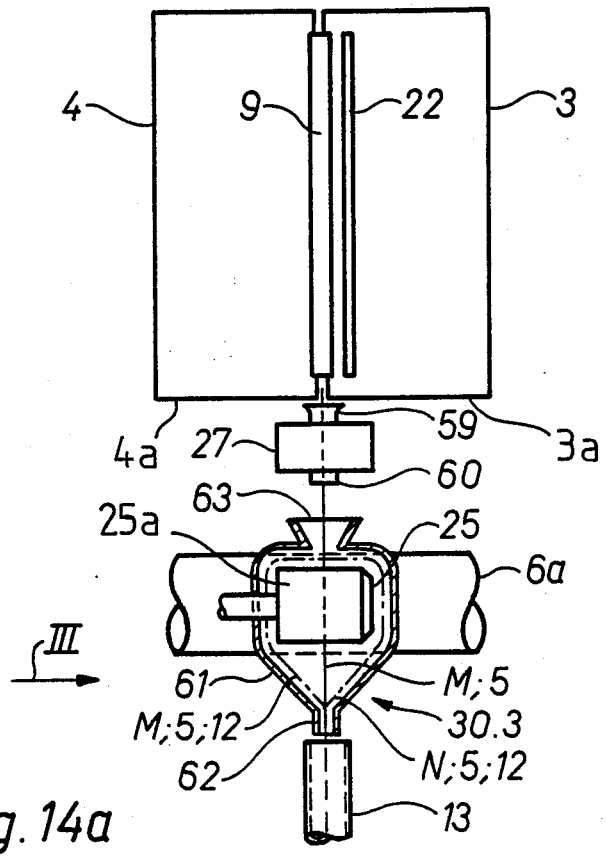
FIG. 14 schematically illustrates a seventh exemplary embodiment of start spinning device according to the present invention.
Figure 14A:
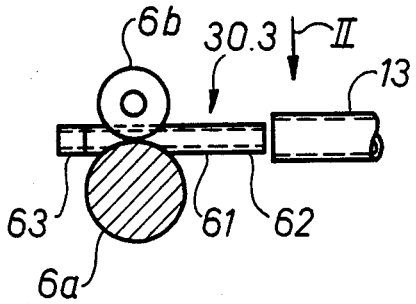
FIG. 14*a* is a fragmentary sectional view start spinning device of FIG. 14, looking substantially in the direction of the arrow III thereof.

FIGS. 14 and 14*a* depict another variant of a yarn guiding or entraining element comprising the injector part or element 27 with an inlet 59 and an outlet 60 and a yarn guiding or guide duct 30.3 which, unlike the previous such ducts described herein, extends around the non-continuous yarn draw-off or withdrawal roll 6*b* not only at its free end 25 but also at the opposite end 25*a*. Consequently, the twisted fiber structure or coil 12 or yarn 5, as the case may be, delivered by the injector part or element 27 need not be forced away in but one direction by the employment of special steps or measures; instead the twisted fiber structure or coil 12 and the following yarn 5 can, depending upon the flow arising, bypass or shunt the yarn draw-off or withdrawal rolls 6*b* in one direction or the other.

The injected air flow and the air flow produced by the suction or extraction device must have sufficient energy to guide the twisted fiber structure or coil 12 unequivocably around the yarn draw-off or withdrawal roll 6*b* towards the suction device 13 and the appropriate amount of energy must be determined by testing.

Just as in the variant constructions hereinbefore described, the heretofore considered parts or components have been generally designated by the same reference characters. It is also remarked that FIG. 14 is a plan view looking in the direction indicated by arrow II in FIG. 14*a*, whereas FIG. 14*a* is a side view looking in the direction of arrow III of FIG. 14.

The yarn guiding or guide duct 30.3 has a casing or housing 61 containing an outlet 62 and an inlet funnel or funnel member 63 defining an inlet opening.

This funnel or funnel member 63 is operative to receive the twisted fiber structure or coil 12, and the yarn 5 which follows the same, entrained by the injector part or element 27 at the start of spinning in a free air jet, while the casing outlet 62 delivers the twisted fiber structure or coil 12 to the suction nozzle or extractor or suction device 13.

As clearly depicted by the showing of FIG. 14, the start-up-spinning yarn path N can extend to the right and to the left, considered with reference to FIG. 14, of the yarn draw-off or withdrawal roll 6*b*. The injector part or element 27 and the yarn guiding or guide duct 30.3 are rigidly arranged.

Figure 15:
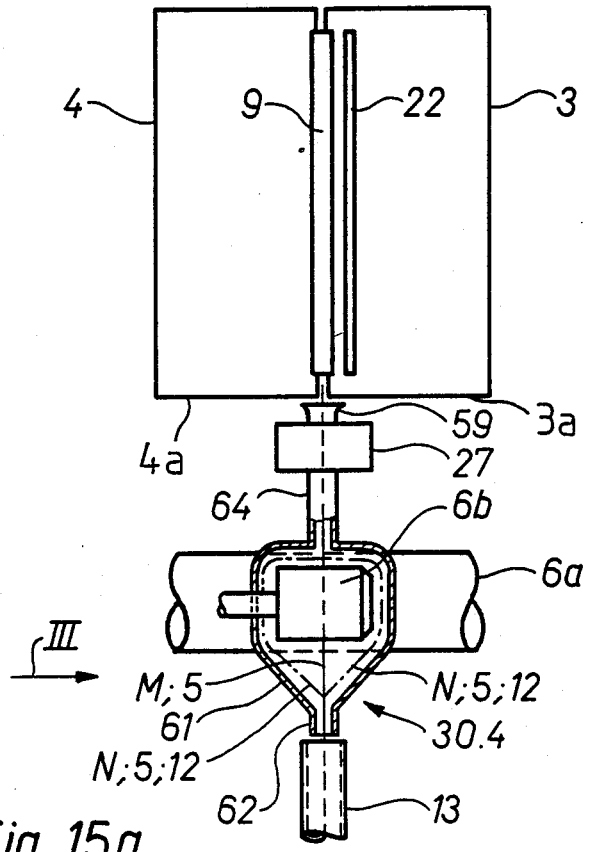
Figure 15A:
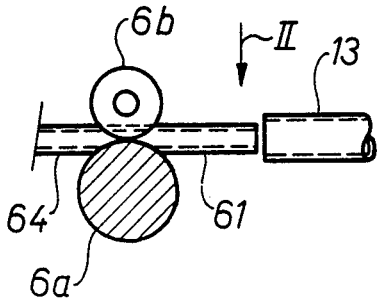
* and FIG. 15*a* is a fragmentary sectional view of the start spinning device of FIG. 15, looking substantially in the direction of the arrow III thereof.

Finally, FIGS. 15 and 15*a* show a variant of the start spinning device depicted in FIGS. 14 and 14*a* wherein, again as a matter of convenience, the same elements generally have the same reference characters. FIGS. 15 is a plan view looking in the direction of arrow II of FIG. 15*a*, whereas FIG. 15*a* is a side view looking in the direction of arrow III of FIG. 3.

In this variant embodiment, instead of the funnel or funnel member 63 of the yarn guiding or guide duct 30.3 of the embodiment of FIGS. 14 and 14*a*, here a yarn guiding or guide duct 30.4 has a connecting or connection tube or member 64 which connects the injector part or element 27 to the casing or housing 61. The yarn guiding or guide duct 30.4 and, therefore, the injector part or element 27 are rigidly or fixedly arranged in any desired manner.

While there are shown and described present preferred embodiments of the invention, it is to be distinctly understood that the invention is not limited thereto, but may be otherwise variously embodied and practiced within the scope of the following claims. Accordingly,

What I claim is:

1. In a method of performing a start spinning operation entailing starting or recommencing spinning of a yarn in a friction spinning apparatus, wherein freely floating fibers are delivered in a fiber infeed duct to a friction spinning surface of friction spinning means of the friction spinning apparatus, the fibers are conveyed on the friction spinning surface to a yarn formation location at which there is produced a yarn, and the yarn is withdrawn by yarn draw-off means, the improvement comprising the steps of:

conveying fibers to the yarn formation location;

twisting the fibers at the yarn formation location so as to form a twisted fiber structure of substantially predeterminate size;

generating an air jet for bypassingly conveying the twisted fiber structure and a yarn formed subsequent thereto past the yarn draw-off means;

engaging the twisted fiber structure and the subsequent formed yarn by yarn take-up means disposed after the yarn draw-off means with respect to a predeterminate direction of movement of the yarn;

interrupting the air jet; and introducing the yarn into the yarn draw-off means.

2. The method as defined in claim 1, further including the step of:

generating the air jet only after elapse of a predetermined time following initiation of conveyance of the fibers to the yarn formation location.

3. The method as defined in claim 1, further including the steps of:

employing the air jet prior to conveyance of the fibers to the yarn formation location in order to clean friction spinning drums constituting the friction spinning means of the friction spinning apparatus; and then interrupting the air jet following cleaning of the friction spinning drums.

4. The method as defined in claim 1, further including the steps of:

producing a further air jet, in addition to the air jet serving for bypassingly conveying the twisted fiber structure and the yarn formed subsequent thereto past the yarn draw-off means; and employing said further air jet for conveying the twisted fiber structure between the yarn formation location and the yarn draw-off means.

5. The method as defined in claim 4, further including the step of:

adjusting both the intensity of the air jet for bypassingly conveying the twisted fiber structure and the yarn formed subsequent thereto and the further air jet which conveys the twisted fiber structure between the yarn formation location and the yarn draw-off means.

6. The method as defined in claim 4, further including the step of:

interrupting the air jet for bypassingly conveying the twisted fiber structure and the yarn formed subsequent thereto prior to interrupting the further air jet which conveys the twisted fiber structure between the yarn formation location and the yarn draw-off means.

7. The method as defined in claim 4, further including the step of:

interrupting the further air jet which conveys the twisted fiber structure between the yarn formation location and the yarn draw-off means after the yarn take-up means has taken-up the twisted fiber structure.

8. The method as defined in claim 1, further including the step of:

performing the start spinning operation at a predeterminate production speed of the friction spinning means.

9. The method as defined in claim 1, further including the step of:

controlling the air jet such that a central flow line thereof is at an angle less than 45° to a yarn end of the yarn and such that said air jet produces a force component conveying the twisted fiber structure towards said yarn draw-off means.

10. A device for performing a start spinning operation entailing starting or recommencing spinning of a yarn in a friction spinning apparatus, wherein:

said friction spinning apparatus comprises:

first friction spinning means provided with a friction spinning surface;

said first friction spinning means defining a yarn formation location at which there is formed a twisted fiber structure;

means for delivering fibers to the friction spinning surface of the first friction spinning means;

the fibers being formed into the twisted fiber structure at the yarn formation location during the start spinning operation;

a pair of yarn draw-off rolls for withdrawing the twisted fiber structure in the form of a yarn in a yarn withdrawal direction;

at least one roll of said pair of yarn draw-off rolls comprising a non-continuous yarn draw-off roll;

a second friction spinning means arranged in close proximity but in non-contacting relationship with respect to the first friction spinning means;

said first and second friction spinning means forming therebetween a gap of substantially constant but predeterminate width;

said device for performing the start spinning operation comprising:

a blowing duct through which travels an air jet;

said blowing duct having an outlet and a predeterminate blowing direction for the air jet;

the outlet of said blowing duct being directed towards the yarn formation location and the blowing direction being oriented such that thrust of the air jet is divisible into two force components of different magnitudes defining a force component of larger magnitude and a force component of smaller magnitude;

the force component of larger magnitude being effective in the yarn withdrawal direction;

a yarn take-up means disposed after the pair of yarn draw-off rolls viewed in the yarn withdrawal direction; and a yarn guiding element provided between the first and second friction spinning means and the yarn draw-off rolls for enabling the twisted fiber structure and a portion of the air jet in the blowing duct to bypass the non-continuous yarn draw-off roll such that the twisted fiber structure and a subsequent yarn portion can be engaged by the yarn take-up means.

11. The device as defined in claim 10, wherein:

said yarn guiding element comprises a pneumatic yarn entraining nozzle and a yarn guiding duct; and said yarn guiding duct taking over said yarn and air entraining the yarn from said pneumatic yarn entraining nozzle and moving said yarn past the non-continuous yarn draw-off roll.

12. The device as defined in claim 11, wherein:

said pneumatic yarn entraining nozzle comprises an injector part for producing an of predeterminate direction.

13. The device as defined in claim 11, wherein:

said non-continuous yarn draw-off roll has a free end; and said yarn guiding duct extending around said free end of said non-continuous yarn draw-off roll.

14. The device as defined in claim 13, wherein:

said pneumatic yarn entraining nozzle comprises an injector part for producing an air jet of predeterminate direction; and said pneumatic yarn entraining nozzle and said yarn guiding duct being structured such that with the air jet operative the yarn is guided around said free end of said non-continuous yarn draw-off roll and upon interruption of said air jet the yarn is released for introduction between the pair of yarn draw-off rolls.

15. The device as defined in claim 14, wherein:

said pneumatic yarn entraining nozzle and said yarn guiding duct are separated from one another; and said yarn guiding duct being provided over substantially its entire length with a slot directed towards said non-continuous yarn draw-off roll.

16. The device as defined in claim 15, wherein:

said pneumatic yarn entraining nozzle extends substantially in a predetermined direction of yarn movement;

said pneumatic yarn entraining nozzle having an outlet;

said yarn guiding duct including a bend provided at the outlet of the pneumatic yarn entraining nozzle for deflecting the air jet;

said pair of draw-off rolls having an axial direction of extent;

said yarn guiding duct having an inlet;

said bend possessing a curvature sufficient to deflect the twisted fiber structure and the subsequent yarn portion in a direction substantially parallel to said axial direction of extent of said yarn draw-off rolls;

said curvature of the bend extending towards the inlet of the yarn guiding duct but failing to extend into an operative path of the yarn; and said operative path of the yarn being defined by a path which is followed by the yarn when the yarn is engaged in operation by the pair of yarn draw-off rolls.

17. The device as defined in claim 15, wherein:

said yarn guiding duct has an inlet;

said pneumatic yarn entraining nozzle has an entry bend;

said entry bend of said pneumatic yarn entraining nozzle being disposed forwardly of said injector part such that an entraining airstream produced by said injector part is directly delivered at said inlet of said yarn guiding duct; and said entry bend of said pneumatic yarn entraining nozzle and said injector part being arranged such that the yarn present in an operative path of the yarn, defining a path followed by the yarn when engaged in operation by the pair of yarn draw-off rolls, can extend freely through said pneumatic yarn entraining nozzle.

18. The device as defined in claim 17, further including:

an elongate tubular part extending from said injector part;

said elongate tubular part having an outlet;

said entraining airstream passing through said elongate tubular part;

said outlet of said elongate tubular part being directed towards said inlet of said yarn guiding duct; and said elongate tubular part being formed with a slot disposed near said pair of yarn draw-off rolls such that said yarn when present in the operative path can extend freely through said pneumatic yarn entraining nozzle.

19. The device as defined in claim 15, wherein:

said pneumatic yarn entraining nozzle is substantially straight over its entire length;

said pneumatic yarn entraining nozzle having an outlet;

said yarn guiding duct having an inlet;

drive means for pivoting said pneumatic yarn entraining nozzle from a start-up-spinning position in which said outlet of said pneumatic yarn entraining nozzle is directed towards said inlet of said yarn guiding duct into an operative position in which said outlet of said pneumatic yarn entraining nozzle is directed towards said pair of yarn draw-off rolls in an operative path of the yarn, which path is followed by the yarn when the yarn is engaged in operation by the pair of yarn draw-off rolls, and in which operative path the yarn can extend freely through said pneumatic yarn entraining nozzle.

20. The device as defined in claim 14, wherein:

said pneumatic yarn entraining nozzle and said yarn guiding duct collectively form a single part;

said yarn guiding duct being formed over its entire length with a slot directed towards the non-continuous yarn draw-off roll;

said pneumatic yarn entraining nozzle having a first wall disposed substantially parallel to a predeterminate direction of guidance of the yarn;

said first wall being provided with an injection orifice for the entraining air;

said injection orifice of the first wall being disposed at a predetermined distance from the non-continuous yarn draw-off roll;

said pneumatic yarn entraining nozzle having a second wall located opposite said first wall; and said second wall being directed away from the first wall substantially at a location disposed opposite to said injection orifice so as to form, at a joint location with said yarn guiding duct, a surrounding portion for surrounding the free end of said non-continuous yarn draw-off roll.

21. The device as defined in claim 14 wherein:

said non-continuous yarn draw-off roll has an end opposite said free end which defines a driven end; and said yarn guiding duct extending around said non-continuous yarn draw-off roll at both said free end and said driven end.

22. The device as defined in claim 21, wherein:

said pneumatic yarn entraining nozzle comprises said injector part;

said yarn guiding duct having means defining an inlet opening;

said injector part being directed such that a free entraining air jet entrains said twisted fiber structure and the subsequent yarn portion into the inlet opening of the yarn guiding duct;

said free entraining air jet and the yarn present in an operative yarn path are arranged substantially coaxially with respect to one another; and said operative path defining a path followed by the yarn when engaged in operation by the pair of yarn draw-off rolls.

23. The device as defined in claim 21, wherein:

said pneumatic yarn entraining nozzle comprises the injector part and a connecting member;

said injector part merging with said connecting member;

said yarn guiding duct having an inlet; and said connecting member extending in a predetermined direction of conveyance of the yarn and being rigidly connected to the inlet of the yarn guiding duct.

24. The device as defined in claim 11, wherein:

said pneumatic yarn entraining nozzle comprises a substantially straight tube;

drive means for pivoting said substantially straight tube;

said drive means comprising an air jet and a compression spring;

said air jet pivoting the substantially straight tube into said start-up-spinning position and said compression spring pivoting said substantially straight tube into said operative position; and said air jet also defining said entraining air of the pneumatic yarn entraining nozzle.

* * * * *